US006584773B2

(12) United States Patent
Ledys et al.

(10) Patent No.: US 6,584,773 B2
(45) Date of Patent: Jul. 1, 2003

(54) PROJECTILES TO TRIGGER AVALANCHES

(75) Inventors: Francis Ledys, Saint Florent sur Cher (FR); Bernard Martiquet, Pigny (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 10/069,774

(22) PCT Filed: Jun. 29, 2001

(86) PCT No.: PCT/FR01/02082

§ 371 (c)(1),
(2), (4) Date: Feb. 26, 2002

(87) PCT Pub. No.: WO02/03014

PCT Pub. Date: Jan. 10, 2002

(65) Prior Publication Data

US 2002/0121214 A1 Sep. 5, 2002

(30) Foreign Application Priority Data

Jul. 5, 2000 (FR) ..... 00 08850

(51) Int. Cl.[7] ..... F01B 29/08
(52) U.S. Cl. ..... 60/634; 60/635; 60/637
(58) Field of Search ..... 60/632, 634, 635, 60/637

(56) References Cited

U.S. PATENT DOCUMENTS

| | | | | | |
|---|---|---|---|---|---|
| 3,643,329 | A | * | 2/1972 | Lieberman | 30/180 |
| 3,712,171 | A | * | 1/1973 | Sweigart | 89/7 |
| 4,034,816 | A | * | 7/1977 | Lutich et al. | |
| 4,109,884 | A | | 8/1978 | Kranz et al. | |
| 4,365,471 | A | * | 12/1982 | Adams | 60/39.76 |
| 4,510,748 | A | * | 4/1985 | Adams | 60/772 |
| 4,658,588 | A | | 4/1987 | Pinson | |

FOREIGN PATENT DOCUMENTS

| | | |
|---|---|---|
| DE | 251079 | 6/1911 |
| FR | 994041 | 11/1951 |
| FR | 2 470 949 | 6/1981 |

* cited by examiner

*Primary Examiner*—Hoang Nguyen
(74) *Attorney, Agent, or Firm*—Parkhurst & Wendel, L.L.P.

(57) ABSTRACT

A projectile for being propelled along a trajectory by propellant gases inside a launcher tube, the projectile including a casing, first pressure means for first pressurizing the casing without exploding the casing during firing of the projectile, and second pressure means for second pressurizing and exploding the casing, wherein the first pressure means includes part of propellant gases inside a launcher tube used to propel the projectile, or alternatively, gases generated by the first pressure means.

26 Claims, 5 Drawing Sheets

PROJECTILES TO TRIGGER AVALANCHES

FIELD OF THE INVENTION

The technical scope of the invention is that of devices, and notably projectiles, able to trigger an avalanche.

It is known to artificially trigger avalanches, this in order to prevent too great an accumulation of snow in an avalanche corridor thereby reducing the risks to the buildings and persons located on the lower part of the slope.

BACKGROUND OF THE INVENTION

Known devices enabling avalanches to be triggered are either fixed or mobile.

Fixed installations are costly. Indeed, the infrastructure are generally built in places that are difficult to reach, and they also require electrical or fluid (combustible gas) connections, which are difficult to ensure.

Thus, patent FR-2771168 describes an avalanching device that pumps up balloons using an explosive gas.

Patent FR-2636729 proposes the permanent installation of an explosive gas generating ramp oriented towards the slope.

Other devices more often than not implement a compressed air gun that launches an explosive projectile triggered by an impact fuse. U.S. Pat. No. 5,872,326 describes such a projectile.

These devices also have drawbacks.

Thus, the conditions of use are limited by the safety of the explosives being implemented (transport, storage, loading). Moreover, in the event of a malfunction, an explosive projectile risks being present on the ground, thereby posing a risk to safety and the environment.

Up to now, these risks have been attenuated through the use of dual component explosives. Two components are mixed in the projectile body in-situ before firing. Individually the components are inoffensive thereby ensuring their safe transportation and storage. The mixture is explosive but becomes inert after a period of 48 hours thereby eliminating risks linked to the abandonment in situ of non-ignited projectiles.

However, the projectiles are difficult to implement since they require the components to be mixed together in situ. This operation is made difficult by the climatic conditions (cold, damp) and the topography of the terrain (hilly). Thus, in practical terms, known projectiles are either fired from a fixed platform, or brought vertically by helicopter in the vicinity of the avalanche corridor. Once again, implementation is both complicated and costly.

A further drawback lies in the event of the inadvertent suspension of fire for whatever reason (bad weather, launcher breakdown . . . ). If the explosive mixture has been made and firing is not possible, then the live projectile has to be kept in storage for 48 hours.

SUMMARY OF THE INVENTION

The aim of the invention is to propose a projectile to trigger avalanches that overcomes such drawbacks.

Thus, the projectile according to the invention is simple to implement since it does not require an explosive mixture to be prepared in situ. It may be easily implemented whatever the terrain and notably using light launchers that can be brought by trackers.

It offers an excellent level of safety, both before and after firing, in the event of a triggering failure.

Thus, the invention relates to a projectile to trigger avalanches and intended to be projected by a launcher tube, such projectile comprising a casing intended to explode in the vicinity of or in contact with the snow through the action of priming means in order to cause an avalanche, wherein said casing is able to be pressurized during firing and/or during its trajectory, the pressurization of said casing thus obtained being insufficient by itself to ensure the exploding of the casing, other means being provided to overpressure the casing thereby ensuring its exploding.

The pressurisation of the casing during firing may be obtained by using part of the propellant gases, inside the launcher tube, used to fire the projectile.

The casing may be pressurized during firing and/or during trajectory by means of first gas-generating means integral with the projectile and ignited during firing.

According to a first embodiment, the projectile comprises a piston pushed by the gas pressure supplied by the launcher or by the first gas generator and allowing the gases to enter the casing, such piston being brought back into a closing position by a return spring and ensuring the gas pressure is maintained inside the casing.

This projectile will also comprise a second gas generator activated by priming means enabling an overpressure of the casing to be ensured causing it to fracture.

Advantageously, the gas pressure generated by the second generator will not be enough to ensure the fracturing of the casing on its own.

The second gas generator may comprise a pyrotechnic composition or a powder charge ignited by priming means.

The priming means may comprise a percussive fuse to ignite the second gas generator when the projectile impacts on the ground.

The projectile may comprise a combustion monitoring device for the pyrotechnic composition or the powder charge.

According to a second embodiment, the second gas generator may ensure the generation of a combustible and/or explosive gas that will be ignited upon impact by priming means.

The second gas generator may comprise calcium carbide that will be mixed with water during the trajectory, the water being contained in a reservoir that will be opened by opening means activated during firing.

The opening means may comprise a riser head able to translate against the action of a return spring, such riser head being pushed towards the reservoir through the inertial force deployed during firing, thereby ensuring the fracturing of the reservoir.

The priming means may comprise a percussive primer placed at a front part of the projectile and ignited by a percussion device.

According to a third embodiment, the first gas generator may ensure the generation of a combustible and/or explosive gas.

The first gas generator may comprise calcium carbide that is mixed with water during the trajectory, the water being contained in a reservoir that will be opened by opening means activated during firing.

The opening means may comprise a piston sliding in the reservoir against the action of a return spring, the piston being displaced during firing through the action of the propellant gases and carrying a pin allowing the reservoir to be pierced thereby ensuring that the water and calcium carbide come into contact with one another.

The calcium carbide may be placed in a spray tube perforated with radial holes, such tube being coaxial to the projectile and placed in the prolongation of the reservoir.

According to one variant, the return spring may be made of a shape-memory material selected and parametered such that it retracts when it reaches a temperature beneath a certain rate and thus no longer exerts the same return force on the piston.

The priming means may comprise a percussive primer placed at a front part of the projectile and ignited by a percussion device.

The priming means may comprise at least one detonating cord placed on an internal surface of the casing.

In any event, the priming means may comprise a primer connected to delay means ignited during firing.

The projectile may comprise a controlled leak device ensuring the gradual depressurisation of the casing.

The controlled leak device may comprise at least one interior cap made of a porous material.

BRIEF DESCRIPTION OF THE DRAWINGS

The invention will become more apparent after reading the description of the different embodiments, such description being made with reference to the appended drawings, in which.

PREFERRED EMBODIMENTS

Figure 1:
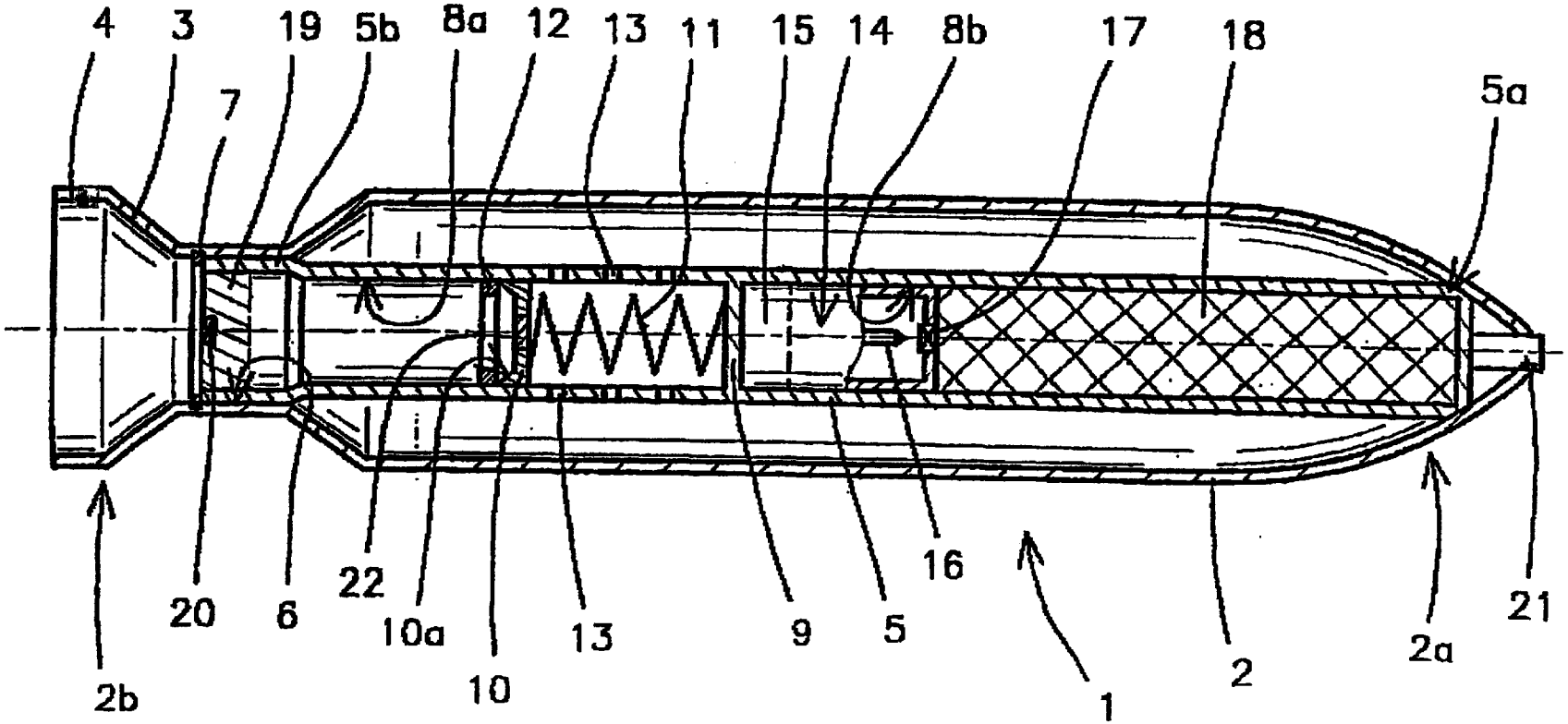
FIG. 1 shows a simplified longitudinal section of a projectile according to a first embodiment of the invention.

With reference to FIG. 1, a projectile 1 according to a first embodiment of the invention, comprises a casing 2 having a cone-shaped front part 2*a* and a rear part 2*b*, constituting an aerodynamic stabiliser, and which is formed of a cone 3 followed by a cylindrical part 4.

The casing 2 may be made of a metallic material, for example 3 mm thick aluminium, or else a composite material, for example carbon fibre or Kevlar filament winding.

The casing 2 accommodates an inner tube 5 that presses by a front seat 5*a* on an inner surface of the casing 2 and which has an enlarged rear part 5*b* fitted to a cylindrical bore 6 in the casing 2. The tube 5 will be made, for example, of a plastic material or of an aluminium alloy.

A stop ring 7 ensures the axial immobilisation of the tube 5 with respect to the casing 2.

The tube 5 has two chambers 8*a*, 8*b* separated by a wall 9. The rear chamber 8*a* encloses a sliding piston 10 that is pushed by a return spring 11 and abuts against a stop nut 12 screwed inside the tube 5.

The piston 10 has a rear sealing lip 10*a*.

The axial part of the piston 10 receives a cap 22 made of a porous material, for example sintered bronze.

This cap 22 constitutes a controlled leak device enabling a slow and gradual depressurisation of the inside of the casing 2.

Radial holes 13 are arranged in the tube 5 between the wall 9 and the piston 10 when the latter is in its starting position shown in FIG. 1 (in abutment against the nut 12).

By way of a variant, the rear chamber 8*a* can also receive a first gas generator 19 that will comprise a primer 20 ignited by the gases supplied by the launcher system (not shown) itself igniting a gas generating pyrotechnic composition of a known type.

The front chamber 8*b* encloses a second gas generator 18 as well as its priming system 14.

This comprises a percussive fuse that is not shown here in details and which incorporates in a known manner a safety and arming device (SAD) 15, a firing pin 16 activated by inertia during impact upon the ground and a percussive primer 17.

The SAD 15 ensures that the firing pin 16 is locked in place during storage phases. It releases the firing pin when the projectile is fired and thus incorporates an inertial lock (not shown). SADs are well known to someone skilled in the art and it is therefore unnecessary to describe such a SAD in further detail.

The primer 17 is intended to ignite the second gas generator 18 that is formed, for example, by a gas generating pyrotechnic composition. Gas generating compositions are well known to the expert. Reference may be made, for example, to U.S. Pat. No. 5,062,367, FR-2691706 and EP-0509655 which describe gas generators that may be used in automobile safety devices.

The second gas generator may also be constituted by a propellant powder charge.

A device 21 to monitor the ignition of the second gas generator 18 is arranged at a front part 2*a* of the casing 2.

This monitoring device 21 will be constituted, for example, by an aluminium rivet carrying, on the external face of the projectile, an axial hole (not shown), that is blocked off, and inside which a fusible material is placed, for example a plastic material (such as polystyrene) or else an eutectic alloy.

The rear face of the rivet 21 is in contact with the composition 18 or with a case enclosing it. The heat given off by its combustion ensures the liquefaction of the fusible material placed in the rivet 21.

This projectile operates as follows.

According to a preferred variant of the invention, no first gas generator 19 is provided.

The projectile 1 is installed into a launcher tube (not shown), for example a pneumatic launcher tube supplying pressurized gas, or else a light launcher for pyrotechnic charges (for example, of the type described in patent FR-2576682).

The gas pressure supplied by the launcher is applied to the piston 10 which is pushed against the action of the return spring 11. The piston 10 thus releases the holes 13 which allow a passage for the gases supplied by the launcher. The gas is thus pressurized inside the casing 2.

When the projectile exits the launcher tube, the pressure applied to the rear of the piston 10 is reduced. The pressure of the gases enclosed in the casing push (with the spring 11) the piston 10 against its stop nut 12. The casing is thereby pressurized during firing.

By way of example, for a pneumatic launcher having a range of 3000 m, a gas pressure of 400 bars is supplied by the launcher which is enough to pressurise the inside of the casing to a pressure of 200 to 300 bars.

The casing 2 will be defined so as to be able to withstand the initial pressurisation without damage.

If the launcher is not able to supply enough gas pressure (which would be the case, for example, for a compact short-range launcher) first gas generating means 19 will be provided. This generator will be ignited when the projectile is fired, for example through the action of the hot gases supplied by the launcher and applied directly on to the primer 20. An inertia operated firing pin system may also be provided that will cause the ignition of this generator 19 during firing.

The first gas generator 19 will ensure the casing 2 is pressurized according to the mechanism described above: displacement of the piston 10, entrance of the gases in the casing 2 through the holes 13, return of the piston 10 when the internal pressure of the casing (added to the force supplied by the spring 11) exceeds that exerted to the rear of the piston 10.

During firing the inertial forces caused the SAD 15 to unlock, allowing the firing pin 16 to ignite the primer 17.

Upon impact on the ground, the deceleration to which the projectile is subjected causes the primer 17 to ignite and prime the second gas generator 18.

This is dimensioned so as to ensure an overpressure of the casing 2 causing it to fracture. The avalanche results from the exploding of the casing 2.

By way of example, a casing 2 may be provided made of 3 mm thick aluminium. This casing can withstand without damage a pressure of 300 bars. It will explode at a pressure equal to or in excess of 400 bars.

The initial pressurisation supplied by the launcher or the first gas generator will ensure a pressurisation inside the casing of around 200 to 300 bars.

The second gas generator will be dimensioned, for example, so as to supply a pressure of around 100 bars.

Thus, the casing will explode as a result of the gas generator being triggered upon impact on the ground.

Advantageously, the gas pressure generated by the second gas generator will be selected under that required to fracture the casing alone.

Thus, in the event of the second gas generator being accidentally primed during the transportation or storage phases, the pressure generated will not be sufficient to fracture the casing.

If a monitoring device 21 is provided on the projectile, the accidentally priming of the gas generator 18 will be revealed by the fusion of the material placed in the ignition monitoring device.

The pressure generated by this second gas generator will gradually evacuate via the porous cap 22. The porous cap 22 carried by the piston 10 constitutes a controlled leak enabling the gradual depressurisation of the casing 2.

Thus, if an incident should occur related to the second gas generator 18 and the projectile 1 does not explode, the pressure inside the casing will gradually reduce. The porosity will be selected so as to ensure depressurization in approximately 48 hours. Non-exploded projectiles found on the ground after the snow has melted therefore present no danger since they will not contain any pressurized gas.

Moreover, the accidental pressurising of the gas generator 18 when the projectile is being picked up will not be dangerous because this would not be enough to cause the casing 2 to fracture.

Figure 2:
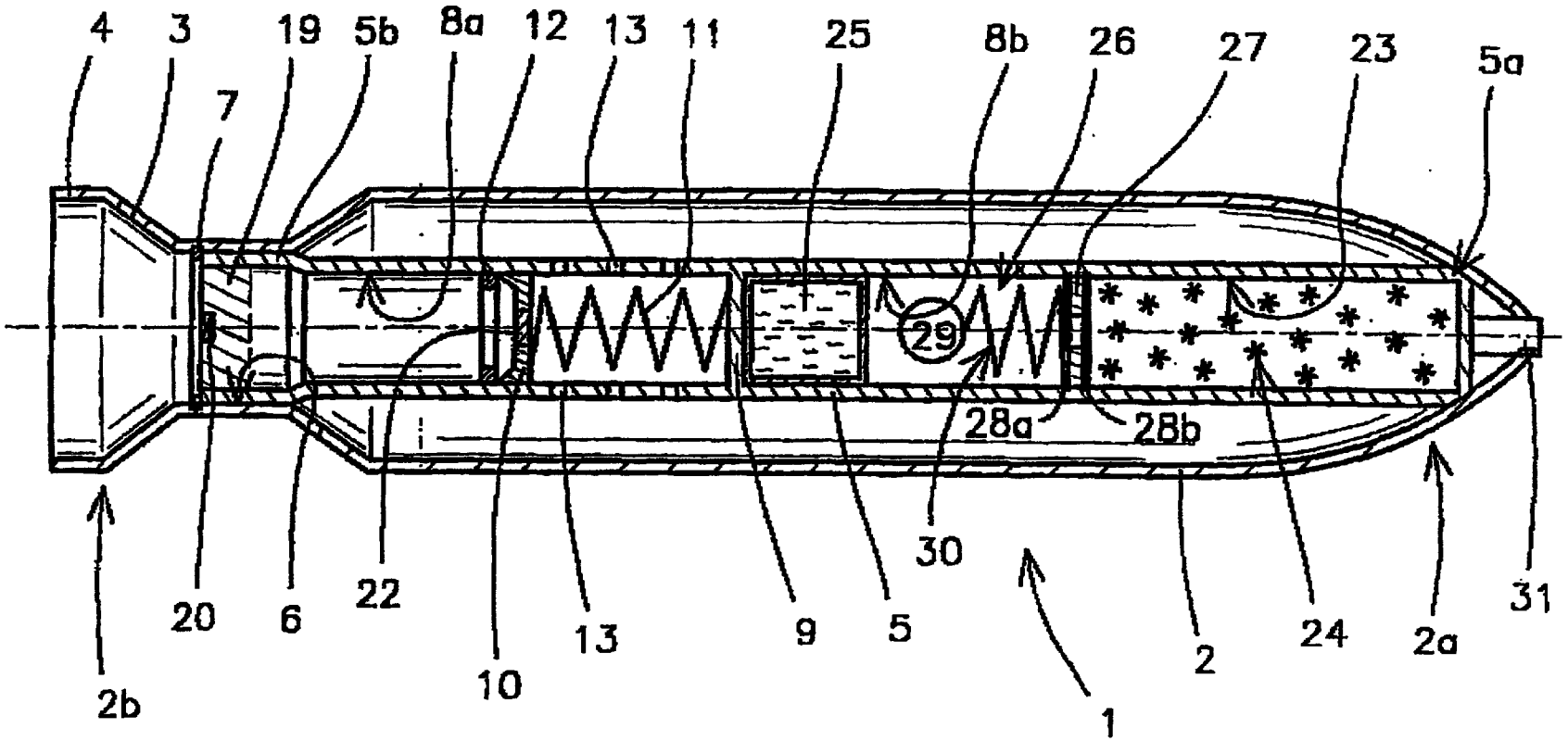
FIG. 2 shows a simplified longitudinal section of a projectile according to a second embodiment of the invention.

FIG. 2 shows a projectile according to a second embodiment of the invention.

This projectile differs from the first one only in that the structure of the second gas generator is different.

Here, the second gas generator is designed so as to ensure the generation of a combustible and/or explosive gas that may be ignited upon impact by priming means.

The second gas generating means comprise a housing 23 filled with calcium carbide 24 in the form of granules.

This calcium carbide is intended to be mixed with water during the trajectory. The water is contained in a reservoir 25 made of a plastic material or of glass and opened by opening means 26 activated by inertia during firing.

A ring-shaped wall 27 is placed at the median part of the front chamber 8*b* and separates the calcium carbide 24 from the water reservoir 25 and its opening means 26.

The ring-shaped wall is made integral with the tube 5 by two flexible rings 28*a*, 28*b*.

According to the embodiment presented, the opening means 26 comprise a riser head 29 able to translate against the action of a return spring 30 fixed to the ring-shaped wall 27.

This riser head is pushed towards the reservoir 25 by the inertial force during firing, thereby fracturing the reservoir.

These opening means are presented here merely by way of illustration. Other inertial opening means may naturally be envisaged. For example, a reservoir 25 may be provided that is itself able to translate through inertia during firing and which impacts against a point integral with the wall 9 of the tube 5.

In a known manner, the mixture of water and calcium carbide causes the generation of acetylene. This gas fills the tube 5. The relative masses of calcium carbide and water will be selected by someone skilled in the art so as to generate the required acetylene gas pressure.

The quantity of gas will be selected to be insufficient upon ignition to fracture the casing 2 of the unpressurized projectile.

The priming means here comprise a percussive primer 31 that is placed at the front part 2*a* of the projectile and which is ignited upon impacting the ground by a percussion device (see FIG. 7), for example a firing pin displaced by the impact on the ground.

This embodiment operates in a similar manner to the previous one.

The projectile casing is unpressurized during the storage and transport phases. Thus, the projectile is totally reliable and safe. Even the accidental ignition of the second gas generator, if it explodes the tube 5, is not enough to cause the projectile casing 2 to fracture.

Upon firing the casing 2 is pressurized, either by using the gases produced by the launcher, which penetrate into the casing via the holes 13 after the piston 10 is displaced, or else by using the gases generated by a first gas generator 19.

At the same time, the water mixes with the calcium carbide and the front chamber 8*b* of the tube 5 is filled with an explosive gas.

Upon impacting on the ground, the acetylene is ignited by the primer 31. This results in the tube 5 exploding and an overpressure that causes the projectile casing 2 to fracture.

As in the previous embodiment, the non-ignition upon impact on the ground has no impact on safety. Indeed, the pressure inside the projectile will gradually decrease thanks to the controlled leakage of the gases through the porous cap 22.

Figure 3:
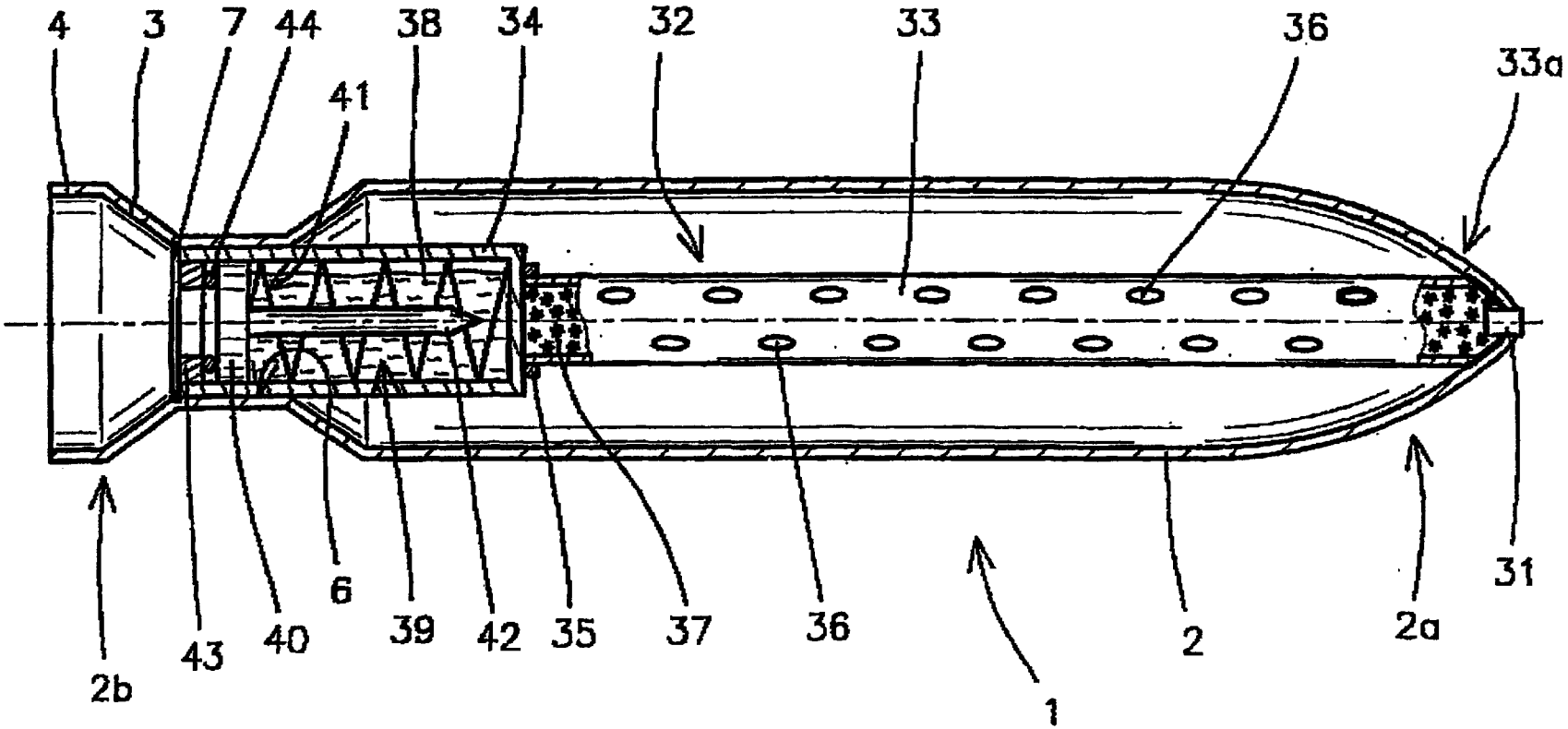
FIG. 3 shows a simplified longitudinal section of a projectile according to a third embodiment of the invention.

FIG. 3 shows a projectile 1 according to a third embodiment of the invention.

This embodiment differs from the previous ones notably in that it only integrates a first gas generator 32 ensuring the generation of a combustible and/or explosive gas that fills the whole of the projectile casing 2.

This first gas generator comprises a tubular sprayer 33 that extends substantially over the full length of the casing 2 between a reservoir 34 and the cone-shaped part of the casing 2.

The sprayer 33 presses by a front seat 33*a* on an inner surface of the casing 2 and is positioned in a centering collar 35 of the reservoir 34.

The reservoir 34 is held in place axially with respect to the casing by means of a flexible ring 7. It is globally cylindrical in shape and is fitted in the bore 6 in the casing.

The spray 33 is perforated in its front part by radial holes 36 and it contains granulated calcium carbide 37. A cylindrical metallic mesh may be placed in the sprayer so as to keep the granules in place and prevent them from exiting through the holes 36.

The reservoir 34 is made of a plastic material. It contains water 38 as well as opening means 39.

The opening means 39 comprise a piston 40 mounted sliding in the reservoir 34 against the action of a return spring 41.

The piston 40 carries a pin 42 that is able to perforate the reservoir 34.

The reservoir 34 is closed by a ring-shaped nut 43 and a seal 44 is placed between the piston 40 and the nut 43.

This projectile operates as follows.

During firing, the gas pressure from the launcher is exerted on the piston 40 which is pushed towards the front of the projectile.

The reservoir 34 is not completely filled with water (the water level 38 has been indicated in the Figure), the displacement of the piston being thus made possible until the reservoir 34 is perforated by the pin 42.

Upon exiting the tube, the pressure exerted on the piston 40 is reduced and the spring 41 brings it back to press against the nut 43.

The water 38 is thus brought into contact with the calcium carbide 37 and the acetylene thereby generated fills the projectile casing 2 via the holes 36 of the sprayer 33.

As in the previous embodiment, the priming means comprise a percussive primer 31 that is placed at the front part 2*a* of the projectile and is ignited upon impact on the ground by a percussion device (not shown), for example, a firing pin displaced by the impact on the ground.

The acetylene is detonated and the resulting overpressure explodes the casing 2.

By way of a variant, a mass of calcium carbide and water may be provided such that the quantity of acetylene generated is enough for the casing to be exploded merely by the impact of the projectile on the ground.

In this case, there is no need to provide a percussive primer 31.

In the event of a misfire, it is crucial to prevent a pressurise projectile containing an explosive gas from being left on the ground.

Means will therefore be provided to ensure the emptying of the projectile casing.

The return spring 41 may, for example, be made of a shape-memory material.

This material will be selected such that it retracts when it reaches a temperature beneath a certain rate and thus no longer exerts the same return force on the piston.

Winter temperatures will cause the spring to be returned to the starting position in which it no longer applies the piston 40 against the nut 43. Advantageously, one end of the spring will be integral with the piston. The retraction of the spring will therefore drive the piston.

Sealing is thus no longer ensured and the gas is able to escape gradually from the casing 2 via the hole 43.

By way of a variant, other means may be provided to ensure the emptying of the projectile casing 2.

Figure 4:
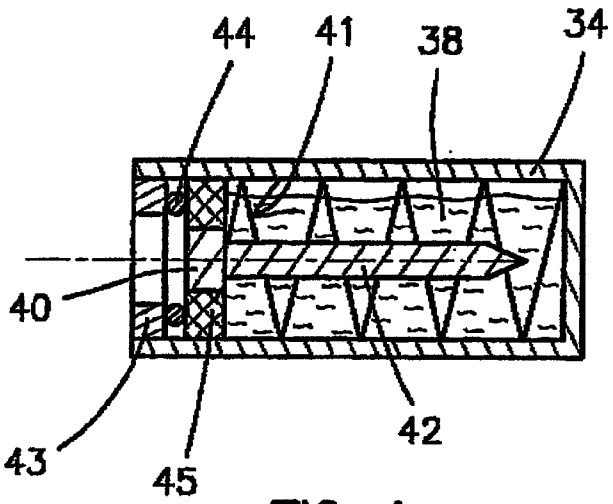
FIG. 4 shows a variant of the piston used in the third embodiment.

FIG. 4 thus shows a detail of a variant in which the piston 40 incorporates a porous ring-shaped part 45 made, for example, of sintered metal and whose porosity is selected such that the water is held in the reservoir but the gases are able to evacuate gradually.

Figure 5:
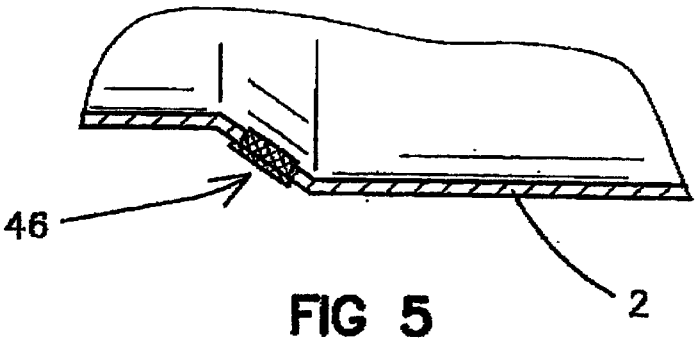
FIG. 5 shows a variant embodiment of a depressurisation cap.

FIG. 5 shows another variant in which a cap 46 of porous material is placed directly onto the casing 2. This variant may also be associated with the embodiments shown in FIGS. 1 and 2.

Figure 7:
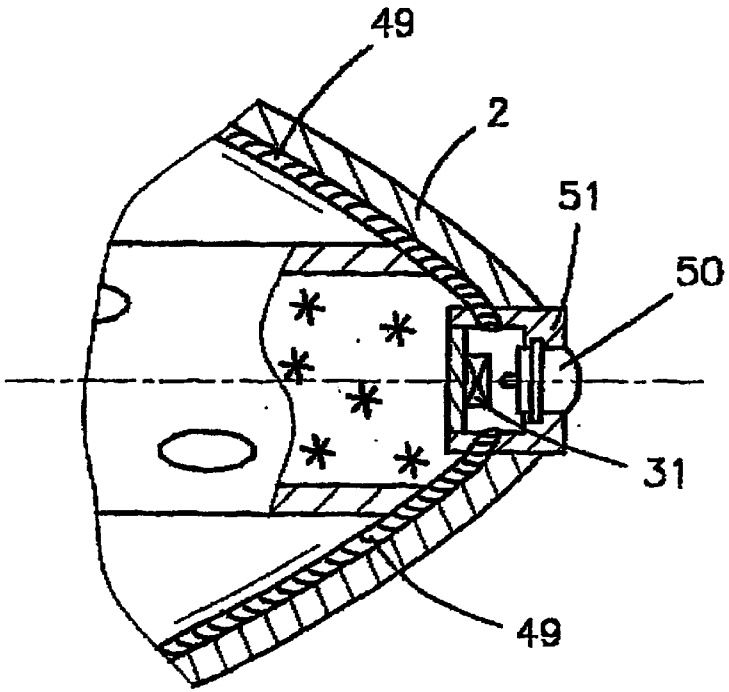

FIG. 7 shows a variant of a third embodiment of the invention in which, so as to facilitate the fracturing of the projectile casing 2, a detonating shearing cord 49 has been provided fastened to the inner surface of the casing 2, for example by bonding (detonating cords are well known to the expert).

Such a variant also improves the ignition of the explosive gas filling the casing 2.

FIG. 7 also shows a percussive primer 31 that ignites the detonating shearing cords 49 as well as the mechanical firing pin 50 associated with it. This firing pin is retained with respect to a case 51 by a shearable collar that is fractured during impact.

Other priming means may also be used with one or other of the previous embodiments.

Figure 6:
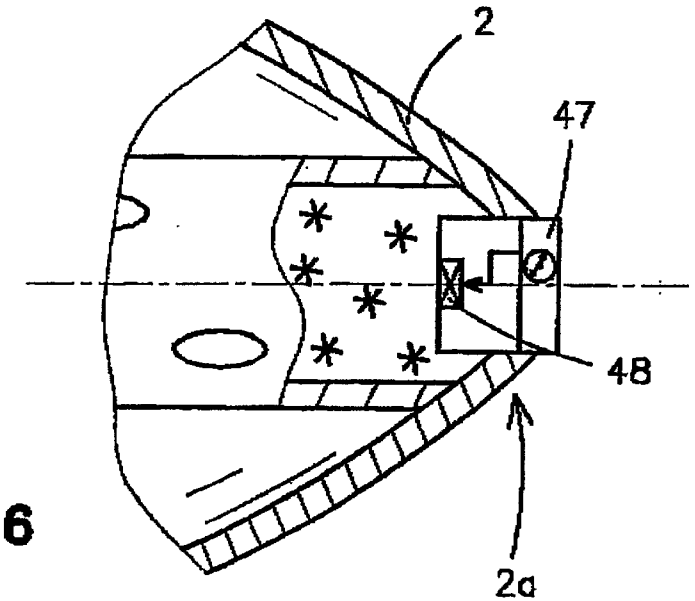
FIG. 6 shows a front part of a projectile according to a third embodiment and equipped with a variant of the priming means, FIG. 7 also shows a front part of a projectile according to the third embodiment equipped with another variant of the priming means.

Thus, FIG. 6 shows a front part of a projectile that carries priming means comprising a primer 48 activated by delay means 47 ignited during firing. A programmable timer delay (for example electronic) may be provided or else a pyrotechnic delay comprising a delay composition that will be ignited during firing.

Such delay means are not described in further detail and are well known to the expert.

Such a variant allows the projectile to be primed whatever the nature of the ground, notably the hardness of the snow. The delay time before ignition will be programmed before firing depending on the range at which the projectile is launched. Ignition will be programmed a little before impact with the snow, or else after the projectile has become buried in the top layer of snow, according to conditions.

Depending on the case, the primer 48 will either ignite the acetylene (embodiment in FIGS. 2 and 3) or the gas generator 18 (embodiment in FIG. 1).

In all the embodiments previously described the pressure causing the casing 2 to fracture may be accurately calibrated by providing incipient fractures on the casing, for example thinned areas.

Figure 8A:
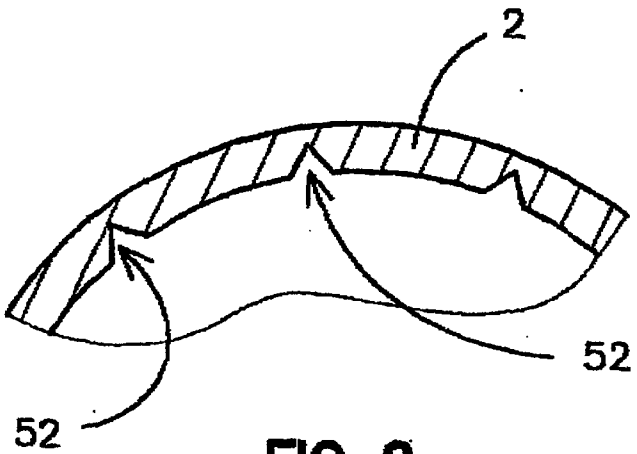
FIGS. 8*a* and 8*b* shows particulars of variant embodiment of the projectile casing.

FIG. 8*a* thus shows the longitudinal incipient fractures 52 that are evenly spaced angularly and which extend over substantially all the length of the casing.

Figure 8B:
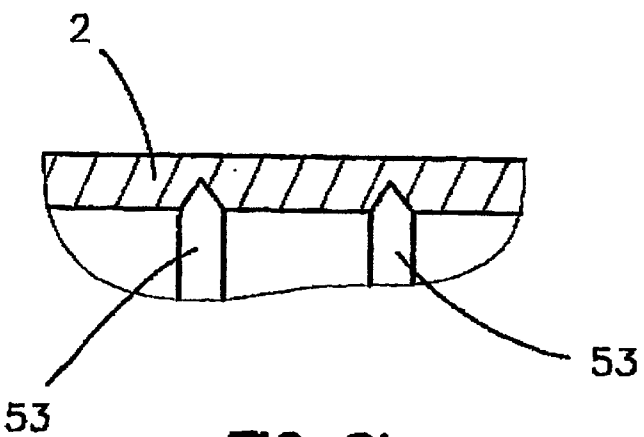

FIG. 8*b* shows ring-shaped incipient fractures 53 that are evenly spaced axially with respect to the casing 2.

What is claimed is:

1. A projectile for being propelled by propellant gases inside a launcher tube and being launched therefrom into a trajectory, the projectile comprising:

a casing;

first pressure means for permitting first pressurizing the casing without exploding the casing during propelling of the projectile; and second pressure means for second pressurizing and exploding the casing, wherein said first pressure means comprises means for receiving propellant gases within a launcher tube.

2. A projectile for being propelled by propellant gases inside a launcher tube and being launched therefrom into a trajectory, the projectile comprising:

a casing;

first pressure means for permitting first pressurizing the casing without exploding the casing during propelling of the projectile; and second pressure means for second pressurizing and exploding the casing, wherein said first pressure means comprises a first gas-generating means integral with said projectile for generating gas, said first gas-generating means for ignition by propellant gases inside a launcher tube.

3. The projectile according to claim 1, further comprising a first return spring and a piston operative by gas pressure inside a launcher tube and for allowing gases in a launcher tube to enter and pressurize said casing, wherein the first return spring is for urging said piston to a closed position to seal the pressurized casing.

4. The projectile according to claim 3, wherein said second pressure means comprises a second gas generator activated by a priming means, said second gas generator for pressurizing said casing to cause said casing to fracture.

5. The projectile according to claim 4, wherein casing is not fracturable by gas pressure generated by said second generator.

6. The projectile according to claim 4, wherein the second gas generator comprises a gas generating composition, said gas generating composition comprising a pyrotechnic composition for ignition by the priming means.

7. The projectile according to claim 4, wherein said priming means comprises a percussive fuse for igniting said second gas generator when said projectile impacts the ground.

8. The projectile according to claim 6, further comprising a combustion monitoring device for monitoring the gas generating composition.

9. The projectile according to claim 4, wherein the second gas generator ensures generation of a gas selected from the group consisting of an explosive gas that is ignited upon impact by said priming means.

10. The projectile according to claim 9, further comprising a reservoir containing water and an opening means, wherein said second gas generator comprises calcium carbide for being mixed with water during the trajectory, said opening means for opening the reservoir during propelling of the projectile.

11. The projectile according to claim 10, further comprising a second return spring, wherein the opening means comprises a riser head for translating against an urging force of the second return spring, said riser head for being pushed towards the reservoir by inertial force deployed during firing, thereby ensuring fracturing of said reservoir.

12. The projectile according to claim 9, further comprising a percussion device, wherein said priming means comprises a percussive primer located at a front part of the projectile and for ignition by the percussion device.

13. The projectile according to claim 2, wherein said first gas generator generates an explosive gas.

14. The projectile according to claim 13, further comprising a reservoir and opening means containing water, wherein said first gas generator comprises calcium carbide for mixing with the water after the projectile has been launched into a trajectory, said opening means for opening the reservoir during propelling of the projectile.

15. The projectile according to claim 14, wherein said opening means comprises a piston for sliding in the reservoir and operable by inertial force during propelling of the projectile and by a predetermined return force generated by a return spring, and a pin carried by the piston for piercing the reservoir to cause the water and the calcium carbide to contact each other.

16. The projectile according to claim 15, further comprising a spray tube perforated with radial holes and containing calcium carbide, said tube being coaxial with the projectile and extending from the reservoir.

17. The projectile according to claim 15, wherein said return spring is made of a shape-memory material for retracting when the material is at a first temperature no greater than a predetermined temperature, wherein at said first temperature said return spring no longer exerts the predetermined return force on the piston.

18. The projectile according to claim 13, further comprising a percussion device, wherein the priming means comprises a percussive primer located at a front part of the projectile and for ignition by the percussion device.

19. The projectile according to claim 13, wherein said priming means comprises at least one detonating cord located on an internal surface of said casing.

20. The projectile according to claim 1, further comprising a delay means, wherein said priming means comprises a primer connected to the delay means for ignition during propelling of the projectile.

21. The projectile according to claim 1, further comprising a controlled leak device for gradual depressurization of the casing.

22. The projectile according to claim 21, wherein said controlled leak device comprises at least one interior cap integral with the casing and comprising a porous material.

23. The projectile according to claim 1, further comprising a first return spring and a piston operative by gas pressure supplied by said first gas generator and for allowing gases supplied by said first gas generator to enter and pressurize said casing, wherein the first return spring is for urging said piston to a closed position to seal the pressurized casing.

24. The projectile according to claim 6, wherein said gas generating composition is a powder charge ignitable by said priming means.

25. The projectile according to claim 21, wherein said controlled leak device comprises a porous material integral with the piston.

26. The projectile according to claim 21, wherein said first gas-generating means comprises an inertia operable firing pin for ignition of said first gas-generating means.

* * * * *

UNITED STATES PATENT AND TRADEMARK OFFICE

CERTIFICATE OF CORRECTION

PATENT NO. : 6,584,773 B2
DATED : July 1, 2003
INVENTOR(S) : Francis Ledys et al.

It is certified that error appears in the above-identified patent and that said Letters Patent is hereby corrected as shown below:

Title page,
Item [86], 371(c)(1), (2), (4) date: change "February 26, 2002" to -- February 28, 2002 --.

Signed and Sealed this

Fourteenth Day of October, 2003

JAMES E. ROGAN
*Director of the United States Patent and Trademark Office*